US010112222B1

(12) United States Patent
Davis et al.

(10) Patent No.: US 10,112,222 B1
(45) Date of Patent: Oct. 30, 2018

(54) SYSTEMS AND METHODS FOR RESOLVING SUBMERSIBLE PUMP FAILURES

(71) Applicant: STATE FARM MUTUAL AUTOMOBILE INSURANCE COMPANY, Bloomington, IL (US)

(72) Inventors: Justin Davis, Bloomington, IL (US); John Hailey, Bloomington, IL (US); Edward P. Matesevac, III, Normal, IL (US); Mark O'Flaherty, Champaign, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 295 days.

(21) Appl. No.: 15/087,223

(22) Filed: Mar. 31, 2016

(51) Int. Cl.
*G06F 11/30* (2006.01)
*B08B 7/02* (2006.01)
*B08B 13/00* (2006.01)

(52) U.S. Cl.
CPC ..... *B08B 7/02* (2013.01); *B08B 13/00* (2013.01)

(58) Field of Classification Search
CPC ..... B08B 7/02; B08B 13/00
USPC ..... 702/183
See application file for complete search history.

(56) References Cited

U.S. PATENT DOCUMENTS

| | | | |
|---|---|---|---|
| 4,795,552 | A | 1/1989 | Yun et al. |
| 5,236,038 | A | 8/1993 | Clemishire |
| 5,426,720 | A | 6/1995 | Bozich et al. |
| 5,672,050 | A | 9/1997 | Webber et al. |
| 6,330,525 | B1 | 12/2001 | Hays et al. |
| 7,309,216 | B1 | 12/2007 | Spadola, Jr. et al. |
| 7,755,318 | B1 | 7/2010 | Panosh |
| 8,892,263 | B1 | 11/2014 | Morris et al. |
| 9,002,528 | B1 | 4/2015 | Morris et al. |
| 9,274,530 | B1 | 3/2016 | Morris et al. |
| 2003/0049134 | A1 | 3/2003 | Leighton et al. |
| 2004/0090197 | A1 | 5/2004 | Schuchmann |
| 2007/0079470 | A1 | 4/2007 | Rippl et al. |
| 2014/0202243 | A1 | 7/2014 | Leonard et al. |

*Primary Examiner* — Anthony Ho
(74) *Attorney, Agent, or Firm* — Marshall, Gerstein & Borun LLP; Randall G. Rueth

(57) ABSTRACT

A method and system resolves failures in a submersible pump. The method and system may receive data from one or more sensors associated with the submersible pump. The method and system may analyze the received data to detect a failure in the submersible pump. The failure may be due to a build-up of debris or particulates that has caused the submersible pump to stall or jam. To resolve the detected failure, the method and system may activate a mechanical shaker coupled to the submersible pump that produces vibrations to physically shake the submersible pump.

21 Claims, 3 Drawing Sheets

SYSTEMS AND METHODS FOR RESOLVING SUBMERSIBLE PUMP FAILURES

TECHNICAL FIELD

The present application relates generally to pumps and, more particularly, to systems and methods for resolving submersible pump failures.

BACKGROUND

Submersible pumps are used in many applications to move fluids (e.g., liquids, slurries, etc.). Typically, these pumps are submersed in the fluids that they are pumping. However, because of the fluid environments that the submersible pumps are placed in, debris or particulates may build up over time, which in turn may interfere with the normal operation of the pumps. For example, particulates may become lodged in or around the pump impellers to create mechanical interferences that can lead to failures in the pumps. The fluid environments also make it difficult to detect and resolve pump failures. Some efforts have been made to detect the onset of a failure by subjecting the pumps to periodic testing with portable equipment. However, the skilled labor associated with periodic testing is costly. Moreover, even if a failure is detected, there still remains the issue of fixing or resolving the failure in an efficient and reliable manner.

SUMMARY

The features and advantages described in this summary and the following detailed description are not all-inclusive. Many additional features and advantages will be apparent to one of ordinary skill in the art in view of the drawings, specification, and claims hereof. Additionally, other embodiments may omit one or more (or all) of the features and advantages described in this summary.

A computer-implemented method for resolving failures in submersible pump may comprise receiving, by one or more processors, data from one or more sensors associated with a submersible pump. The method may also include analyzing, by one or more processors, the received data from the one or more sensors to detect a failure in the submersible pump. In response to detecting the failure in the submersible pump, the method may activate, by one or more processors, a mechanical shaker attached to the submersible pump for one or more operating cycles.

A non-transitory computer-readable storage medium may include computer-readable instructions to be executed on one or more processors of a system for resolving failures in submersible pumps. The instructions when executed, may cause the one or more processors to receive data from one or more sensors associated with a submersible pump. The instructions when executed, may also cause the one or more processors to analyze the received data from the one or more sensors to detect a failure in the submersible pump. In response to detecting the failure in the submersible pump, the instructions when executed, may cause the one or more processors to activate a mechanical shaker attached to the submersible pump for one or more operating cycles.

A system for resolving failures in submersible pumps may comprise a submersible pump, a mechanical shaker coupled to the submersible pump, and a control unit that includes a memory having instructions for execution on one or more processors. The instructions when executed by the one or more processors, may cause the control unit to receive data from one or more sensors coupled to the submersible pump. The instructions when executed by the one or more processors, may also cause the control unit to analyze the received data from the one or more sensors to detect a failure in the submersible pump. In response to detecting the failure in the submersible pump, the instructions when executed by the one or more processors, may cause the control unit to activate the mechanical shaker for one or more operating cycles.

The figures depict a preferred embodiment of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 1:
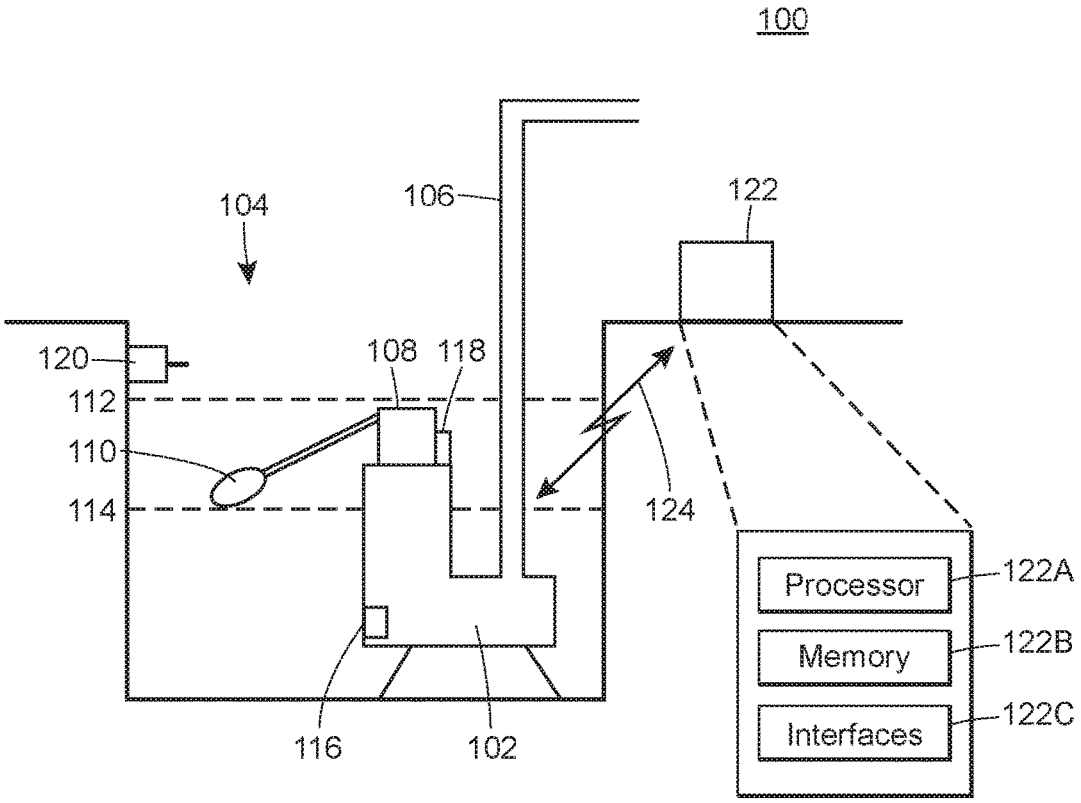
FIG. 1 illustrates an example submersible pump system.

Referring first to FIG. 1, which illustrates an example submersible pump system 100. The example submersible pump system 100 includes a submersible pump 102 that is placed or submersed in a fluid environment 104. The submersible pump 102 may be, for example, a sump pump, a sewage pump, a well pump, a circulation pump, a bladder pump, a grinder pump, a borehole pump, a slurry pump, a fountain pump, a utility pump, etc. The fluid environment 104 may be a basin, a pit, a well, a tank, a container or any other environment in which fluid accumulates or stores.

The submersible pump 102 operates to pump, remove, extract or move fluids (e.g., liquids, slurries, semi-solids, etc.) that may reside in the fluid environment 104. For example, the environment 104 may be a sump basin in the basement of a home, and the pump 102 may be a sump pump placed in the basin to remove water that has collected in the sump basin. As another example, the environment 104 may be a well, the pump 102 may be a well pump placed in the well to provide underground water to a residence or dwelling. As a further example, the environment 104 may be a sewage tank, and the pump 102 may be a sewage pump placed in the tank to pump wastewater to a main sewer line for removal. As yet another example, the environment 104 may be a swimming pool, and the pump 102 may be a circulation pump placed in the swimming pool to circulate the pool water in order to keep the water clear and free of containments like bugs or algae. Still other examples of the environment 104 and the pump 102 may be industrial in nature such as in industrial water extraction, oil well drilling, mine dewatering, irrigation systems, etc. Any or all fluids that are removed or extracted from the environment 104 by the pump 102 may be transported and discharged through a discharge line 106, for example.

Generally, the submersible pump 102 may be electrically powered by hardwiring the pump 102 into an electrical power system. Additionally or alternatively, the submersible pump 102 may be powered by a battery or other independent power source. The submersible pump 102 may include a motor 108 that energizes to pump fluid from the environment 104. The motor 108 may be energized by an activation switch 110 in response to changing fluid levels in the environment 104. As shown in FIG. 1, the activation switch 110 may be a float switch, although other technologies such as liquid level sensors may also be used. In any event, when a current fluid level in the environment 104 reaches a high fluid level 112 (e.g., when the rising fluid lifts the activation switch 110 to the high fluid level 112), the motor 108 may be energized to begin pumping fluid out of the environment 104. As the fluid is pumped out, the current fluid level may drop to an initial fluid level 114 (e.g., when the falling fluid carries the activation switch 110 back to the initial fluid level 114). As this point, the motor 108 may be de-energized so that the fluid level in the environment 104 ceases to drop further.

In some embodiments, the motor 108 may be constantly energized to continuously pump fluid from the environment 104 (e.g., pumping water from a well), or to continuously circulate fluid in the environment 104 (e.g., circulating water in a pool or pond).

When a failure occurs in the submersible pump 102, damages and/or other losses may result. For example, the pump 102 may be a sump pump and the environment 104 may be a sump basin located in the basement of a home. As such, the sump pump 102 may be used to remove water that has accumulated in the sump basin 104. However, when the sump pump 102 experiences a failure and stops working, flooding may ensue as water fills up the sump basin 104 and overflows into the basement. The resulting water damage to the home may be considerable for which adequate insurance coverage may be limited or unavailable. Accordingly, the ability to automatically detect and resolve submersible pump failures is of great importance.

Generally, the submersible pump 102 may experience a failure as a result of mechanical interferences. For example, because the pump 102 is exposed to the fluid environment 104, debris or particulates may build up over time and become lodged in or around an impeller of the pump 102. This is especially relevant when the pump 102 has been sitting idle in the fluid environment 104 for an extended period of time. The built-up debris or particulates may cause the pump impeller to stall or jam, and thus rending the pump 102 inoperable.

One or more sensors may be used to detect a failure caused by mechanical interferences. In one embodiment, a debris sensor 116 may be used. For example, the debris sensor 116 may be placed near the pump impeller to measure the build-up of debris or particulates. In operation, the occurrence or onset of a failure in the pump 102 may be determined if the presence or amount of debris or particulates detected by the sensor 116 exceeds a certain threshold.

In another embodiment, an acoustic sensor 118 may be used. For example, the build-up of debris or particulates may cause the pump impeller to stall or jam. This in turn may cause the motor 108 to produce or emit certain sounds (e.g., high pitch noises) that are indicative of the stalling or jamming. As such, the acoustic sensor 118 may be placed near the motor 108 to measure any acoustic or vibrational changes in the motor 108 as a means to determine the occurrence or onset of a failure in the pump 102.

In still another embodiment, a fluid level sensor 120 may be used. This may be applicable in scenarios where the pump 102 is used to keep the fluid in the environment 104 from overflowing. For example, the fluid level sensor 120 may be placed at a short distance above the high fluid level 112 (as shown in FIG. 1). If the fluid level sensor 120 does not detect any fluid, then the fluid level in the environment 104 may be deemed to be adequate. In other words, the pump 102 is either working properly to pump fluid out of the environment 104, or the fluid level is not yet high enough to activate the pump 102. In either case, it can be assumed that the pump 102 is not experiencing any failure. On the other hand, if the fluid level sensor 120 detects fluid, then the fluid level in the environment 104 may be deemed to be too high. In other words, a dangerous level of fluid is present in the environment 104, which may be caused by a failure that has rendered the pump 102 unable to pump fluid.

It is understood that the above example embodiments are described for illustration purposes. They are not exclusive, and more than one such embodiments may be used or coexist within a single submersible pump system 100. Furthermore, the sensors 116, 118 may be separate modules that are coupled to the pump 102 (as shown in FIG. 1), or the sensors 116, 118 may be integrated into the pump 102.

The various sensors 116-120 may be monitored by a control unit 122, which includes a processor 122A, a memory 122B, and one or more interfaces 122C. The memory 122B stores instructions, data and information that may be executed by the processor 122A to operate the control unit 122. The one or more interfaces 122C may include various interfaces such as a sensor interface that allows the control unit 122 to communicate with the various sensors 116-120, a user interface that allows a user to interact with the control unit 122, a network interface that allows the control unit 122 to communicate with other devices or peripheral equipment, etc. During operation, data and information collected by the various sensors 116-120 may be transmitted to the control unit 122 via a communication link 124, which may be a wired or wireless connection (e.g., Bluetooth). Once received, the control unit 122 may analyze the data and information to determine any failures in the pump 102. Further, while FIG. 1 shows the control unit 122 as being separate from the pump 102, in some embodiments, the control unit 122 may be integrated with or be part of the pump 102.

In addition, the submersible pump 102 may experience a failure as a result of factors affecting the motor 108, such as age, wear, fatigue, etc. Generally, as a motor begins to fail, characteristic changes may appear in the electrical load waveform of the motor. Accordingly, a sensor or monitoring device (not shown) may be used to collect data associated with the electrical load waveform of the motor 108. That data may then be transmitted to the control unit 122 via the link 124. Once received, the control unit 122 may analyze the data for meaningful signatures (e.g., high frequency voltage spikes) that may indicate potential problems with the motor 108 and hence the pump 102. The control unit 122 may receive and analyze the data from the motor 108 either continuously or on an interval basis (e.g., every 5 minutes, every hour, every day, etc.). Examples of the electrical load waveform analysis are described in U.S. Pat. No. 8,892,263, entitled "Systems and Methods for Detecting and Resolving Sump Pump Failures," the entire disclosure of which is hereby incorporated by reference.

Moreover, the submersible pump 102 may experience a failure as a result of the motor 108 running indefinitely. This may occur because of a malfunction in the activation switch 110 or another activation mechanism. For example, if the pump 102 is working properly, then the motor 108 should automatically shut off when the falling fluid carries the activation switch 110 back to the initial fluid level 114. However, if the activation switch 110 jams or otherwise fails, then the motor 108 may become stuck and continue to run for a long time. Thus, the control unit 122 may use a timer to time how long the motor 108 has been running. If the run time of the motor 108 exceeds a certain length of time (e.g., a length of time that the motor 108 should be running under normal operating conditions), then the control unit 122 may determine that the pump 102 is experiencing a failure. In some embodiments, the control unit 122 may employ a timer in conjunction with the fluid level sensor 120. In this scenario, the pump 102 may be deemed to be experiencing a failure if the fluid level sensor 120 is not detecting any fluid but the control unit 122 is detecting a prolonged period of run time on the part of the motor 108.

Figure 2A:
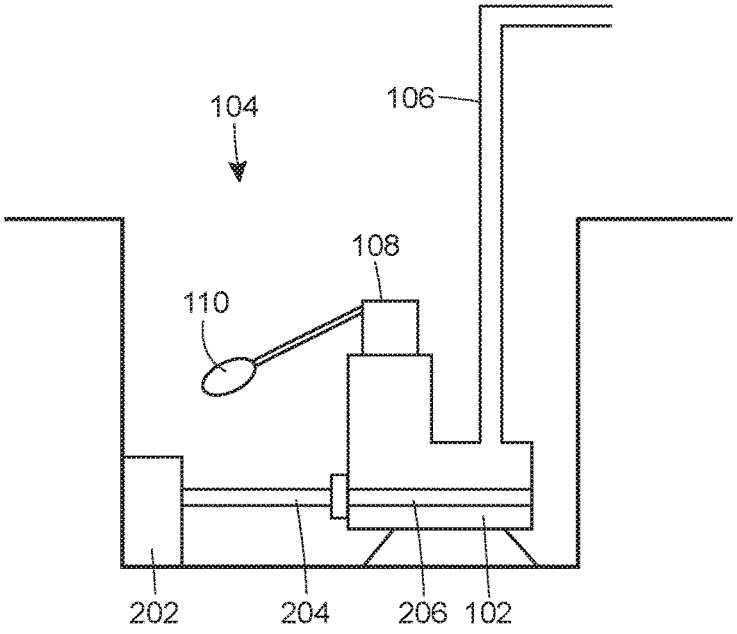
FIGS. 2A and 2B illustrate example configurations for a mechanical shaker that can used to resolve submersible pump failures.
Figure 2B:
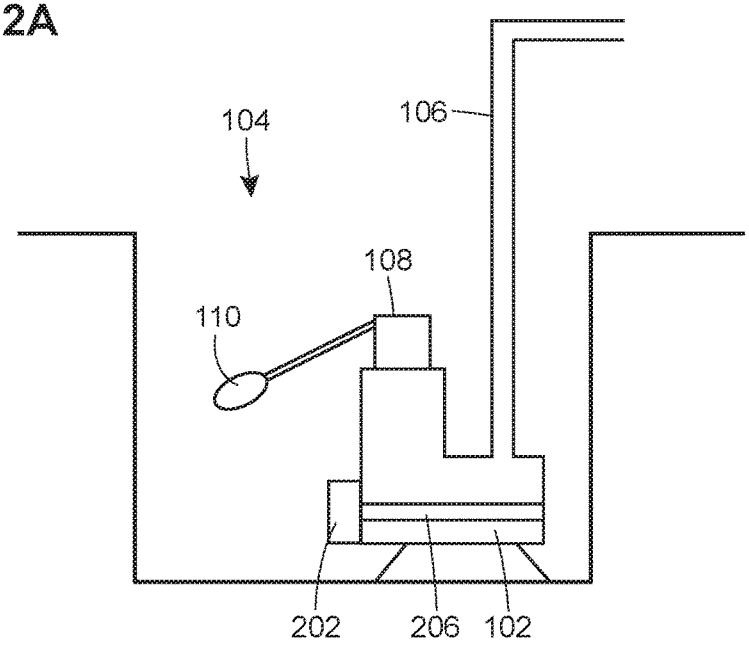

Once a failure has been detected or identified in the pump 102, the failure may be resolved by shaking the pump 102. For example, a simple mechanical shake can often "break loose" a build-up of debris or particulates. Referring next to FIGS. 2A and 2B, which illustrate different configurations for a mechanical shaker 202 that can be used for this purpose. The mechanical shaker 202 may be in the form of an electromechanical vibration device (e.g. a linear motor) that physically agitates or shakes the pump 102.

Each of FIGS. 2A and 2B is illustrated with respect to FIG. 1. As such, each of FIGS. 2A and 2B shows the pump 102 disposed in the environment 104 along with the discharge line 106, the motor 108, and the activation switch 110. In FIG. 2A, the mechanical shaker 202 is configured with a shaker arm 204 that extends horizontally. The shaker arm 204 is then attached to the body of the pump 102 by using clamps 206. When energized, vibrations produced by the mechanical shaker 202 are transferred to the pump 102 via the shaker arm 204. In FIG. 2B, the mechanical shaker 202 is configured to attach to the pump 102 directly. The mechanical shaker 202 may be secured to the body of the pump 102 by using the clamps 206, for example. When energized, vibrations produced by the mechanical shaker 202 are imparted directly onto the pump 102.

The intensity and duration of the vibration produced by the mechanical shaker 202 may be set or adjusted as desired. For example, the mechanical shaker 202 may be set to vibrate intensely and continuously for a short burst of time. As another example, the mechanical shaker 202 may be set to vibrate in multiple operating cycles (e.g., 3 or 5 cycles), with each cycle producing a different level of vibration intensity (e.g., an increase in the level of intensity going from the first cycle to the last cycle). Further, different types of vibration profiles may be specified such as a sine sweep, random vibration, synthesized shock, etc.

In both FIGS. 2A and 2B, the mechanical shaker 202 is shown as a standalone unit that may be retrofitted or added to the pump 102. In some embodiments, the mechanical shaker 202 may be integrated with or be part of the pump 102. Further, the mechanical shaker 202 may be connected to the control unit 122, via the link 124, so that the control unit 122 can control the operation of the mechanical shaker 202.

The mechanical shaker 202 may be automatically activated in response to a detected failure, such as when the amount of debris or particulates detected by the debris sensor 116 exceeds a threshold level, when certain erratic sounds emanating from the motor 108 are detected by the acoustic sensor 118, when fluid overflow is detected by the fluid level sensor 120, when the data associated with the electrical load waveform of the motor 108 indicate abnormalities or deviations, when the motor 108 runs too long, when the motor 108 runs too long in the absence of any fluid overflow detection by the sensor 120, etc. In any or all of these scenarios, the mechanical shaker 202 may be activated in an effort to resolve the failure by, for example, jolting the motor 108 back to life. Of course, using the mechanical shaker 202 is not the only way to resolve failures in the pump 102. In some embodiments, the motor 108 may be automatically cycled on and off in an attempt to restart the motor 108 if potential problems are detected.

Moreover, when a failure in the pump 102 is detected or identified, the control unit 122 may alert or warn a user or repair service provider. For example, the control unit 122 may send a message (e.g., a visual message, an audio message, a text message, an email message, etc.) to a device that the user is using (e.g., a mobile phone, a computer, etc.). The message may specify the failure in the pump 102 and any actions that have been taken to resolve or remedy the failure. In this manner, the user or repair service provider is notified and made aware of the situation.

In some embodiments, the control unit 122 may be integrated with or be part of a control system (e.g., a home automation system). As such, the control unit 122 may communicate data and information to the control system regarding a failure in the pump 102 and/or any actions that were taken in response to the failure. The control system may in turn inform the user or repair service provider and, if desired, instruct the control unit 122 to perform further actions based on any direction or feedback from the user or repair service provider. Similarly, the user or repair service provider may access the control system to view and configure the control unit 122 or any of the components (e.g., the various sensors 116-120) connected to or monitored by the control unit 122.

Communication with the user or repair service provider is also necessary because certain failures in the pump 102 cannot be fully resolved. For example, the motor 108 or parts of the pump 102 may be physically broken, and thus no amount of shaking by the mechanical shaker 202 can remedy the problem. As such, the control unit 122 and/or the control system may send an alarm message to the user or repair service provider stating that manual repairs or replacements are needed as soon as possible.

Figure 3:
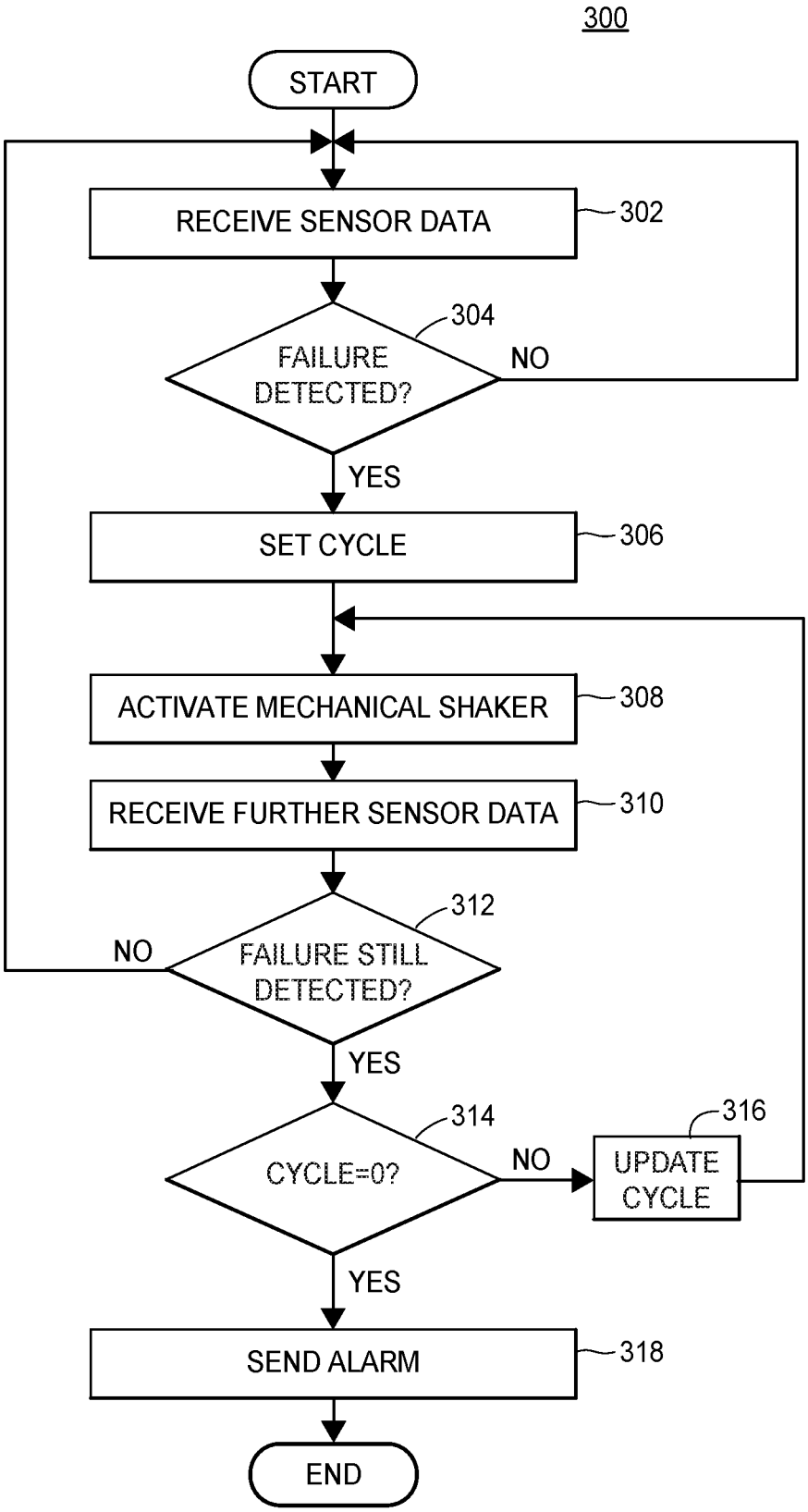
FIG. 3 illustrates a flowchart of an example method for resolving submersible pump failures.

Referring now to FIG. 3, which illustrates a flowchart of an example method 300 for resolving submersible pump failures. The method 300 may include one or more blocks, routines or functions in the form of computer executable instructions that are stored in a tangible computer-readable medium (e.g., 122B of FIG. 1) and executed using a processor (e.g., 122A of FIG. 1). For ease of explanation, FIG. 3 will be described with respect to FIGS. 1 and 2.

The method 300 may begin by receiving sensor data (block 302). Generally, this involves receiving, collecting or obtaining data from one or more sensors that are used to detect failures associated with the submersible pump 102. For example, the method 300 may receive data from the debris sensor 116 that measures the build-up of debris or particulates around an impeller of the pump 102, which may cause the pump 102 to stall or jam. As another example, the method 300 may receive data from the acoustic sensor 118 that identifies certain sounds or noises produced by the motor 108 as a result of the pump impeller being stalled or jammed by the build-up of debris or particulates. As a further example, the method 300 may receive data from the fluid level sensor 120 that determines if the fluid level in the environment 104 is too high as a result of the pump 102 being unable to pump fluid out of the environment 104.

Additionally or alternatively, in some embodiments, the method 300 may analyze the electrical load waveform of the motor 108 to determine if there are failures associated with the motor 108. For example, the method 300 may analyze the electrical load waveform of the motor 108 by performing a frequency analysis, a waveform comparison, an evaluation of waveform values, etc. Here, the purpose is to look for meaningful signatures that may indicate potential problems associated with the motor 108.

Additionally or alternatively, in some embodiments, the method 300 may determine if the motor 108 is running indefinitely. For example, a jam in the activation switch 110 may cause the motor 108 to become stuck. Thus, to make sure that the pump 102 is operating properly, it may be necessary to verify that the motor 108 is not running for an indefinite amount of time (e.g., the run time of the motor 108 does not exceed a certain length of time). In an embodiment, the method 300 may determine how long the motor 108 is running in the absence of any fluid overflow detection by the fluid level sensor 120. In this scenario, the method 300 may determine that the motor 108 is experiencing a failure if the fluid level sensor 120 is not detecting any fluid but the motor 108 is still running for a prolonged period of time.

Based on the data or readings from the various sensors 116-120, the method 300 may determine whether or not a failure has been detected in the pump 102 (block 304). For example, the method 300 may determine the occurrence or onset of a failure in the pump 102 if the presence or amount of debris or particulates detected by the debris sensor 116 exceeds a certain threshold. If no failure is detected, the method 300 may return to beginning of block 302. However, if a failure is detected, then the method 300 may proceed to automatically resolve the failure.

The method 300 may begin to resolve the detected failure by setting up the mechanical shaker 202 (block 306). In particular, the method 300 may specify a number of operating cycles for the mechanical shaker 202 to shake the pump 102. The method 300 may also specify a duration and intensity for each operating cycle. In an embodiment, the method 300 may establish 3 operating cycles, each of which lasts 15 seconds with moderate shaking intensity. Next, the method 300 may activate the mechanical shaker 202 (block 308). The mechanical shaker 202 produces vibrations for the specified duration in each operating cycle in an attempt to shake loose any stall, jam or malfunction, or any build-up of debris or particulates that may be causing the pump 102 to stall or jam.

At the end of the specified duration in each operating cycle, the method 300 may receive further sensor data (block 310). Here, the method 300 may again receive data from the various sensors 116-120 to check if the detected failure has been resolved by the shaking of the mechanical shaker 202. Based on the data or readings from the various sensors 116-120, the method 300 may determine whether or not the failure is still detected (block 312). For example, if, after shaking, the presence or amount of debris or particulates detected by the debris sensor 116 is now below the certain threshold, then the method 300 may determine that the failure no longer exists.

If the failure is no longer detected, then the method 300 may return to beginning of block 302. On the other hand, if the failure is still detected, then the method 300 may determine that the failure has not been resolved. Subsequently, the method 300 may determine if the number of operating cycles has reached zero (block 314). If the number of operating cycles is not zero, the method 300 may update the iteration on the operating cycles (block 316). The method 300 may then proceed to continue operating the mechanical shaker 202 on the pump 102 for the remaining number of cycles at block 308.

If the method 300 determines that the failure is still being detected and that the number of operating cycles has reached zero at block 314, then the method 300 may proceed to send an alarm message (block 318). Here, the detected failure in the pump 102 cannot be fully resolved by simply shaking the pump 102 with the mechanical shaker 202. Manual repairs or replacements must be performed instead. Accordingly, the method 300 may send the alarm message to notify a user or repair service provider of the situation.

In general, while the disclosed systems and methods may be used to detect and resolve submersible pump failures, such systems and methods can also be applied to other types of equipment (e.g., flow operated valves) where it may be useful to shake loose the build-up of debris or particulates. Additionally, the disclosed systems and methods may be applied to pumps in general, such as a pedestal type pump that is mounted above or outside of a liquid environment.

The following additional considerations apply to the foregoing discussion. Throughout this specification, plural instances may implement functions, routines, or operations structures described as a single instance. Although individual functions and instructions of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of functions, components, modules, blocks, or mechanisms. Functions may constitute either software modules (e.g., non-transitory code stored on a tangible machine-readable storage medium) or hardware modules. A hardware module is a tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may include dedicated circuitry or logic that is permanently configured (e.g., as a special-purpose processor, such as a field programmable gate array (FPGA) or an application-specific integrated circuit (ASIC)) to perform certain functions. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term hardware should be understood to encompass a tangible entity, be that an entity that is physically constructed, permanently configured (e.g., hardwired), or temporarily configured (e.g., programmed) to operate in a certain manner or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware and software modules can provide information to, and receive information from, other hardware and/or software modules. Accordingly, the described hardware modules may be regarded as being communicatively coupled. Where multiple of such hardware or software modules exist contemporaneously, communications may be achieved through signal transmission (e.g., over appropriate circuits and buses) that connect the hardware or software modules. In embodiments in which multiple hardware modules or software are configured or instantiated at different times, communications between such hardware or software modules may be achieved, for example, through the storage and retrieval of information in memory structures to which the multiple hardware or software modules have access. For example, one hardware or software module may perform an operation and store the output of that operation in a memory device to which it is communicatively coupled. A further hardware or software module may then, at a later time, access the memory device to retrieve and process the stored output. Hardware and software modules may also initiate communications with input or output devices, and can operate on a resource (e.g., a collection of information).

The various operations of example functions and methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or functions described herein may be at least partially processor-implemented. For example, at least some of the functions of a method may be performed by one or processors or processor-implemented hardware modules. The performance of certain of the functions may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The one or more processors may also operate to support performance of the relevant operations in a "cloud computing" environment or as a "software as a service" (SaaS). For example, at least some of the functions may be performed by a group of computers (as examples of machines including processors), these operations being accessible via a network (e.g., the Internet) and via one or more appropriate interfaces (e.g., application program interfaces (APIs)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of this specification are presented in terms of algorithms or symbolic representations of operations on data and data structures stored as bits or binary digital signals within a machine memory (e.g., a computer memory). These algorithms or symbolic representations are examples of techniques used by those of ordinary skill in the data processing arts to convey the substance of their work to others skilled in the art. As used herein, a "function" or a "routine" is a self-consistent sequence of operations or similar processing leading to a desired result. In this context, functions, algorithms, routines and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "some embodiments" or "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a function, process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description should be read to include one or at least one and the singular also includes the plural unless it is obvious that it is meant otherwise.

Still further, the figures depict preferred embodiments or implementations of a system for resolving submersible pump failures for purposes of illustration only. One of ordinary skill in the art will readily recognize from the foregoing discussion that alternative embodiments or implementations of the structures and methods illustrated herein may be employed without departing from the principles described herein.

Upon reading this disclosure, those of skill in the art will appreciate still additional alternative structural and functional designs for a system and method for resolving submersible pump failures can be used as well or instead. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

We claim:

1. A computer-implemented method for resolving failures in submersible pumps, the method comprising:

receiving, by one or more processors, data from one or more sensors associated with a submersible pump, wherein the one or more sensors comprise at least one of a debris sensor or an acoustic sensor;

analyzing, by one or more processors, the received data from the one or more sensors to detect a failure in the submersible pump; and in response to detecting the failure in the submersible pump, automatically activating, by one or more processors, a mechanical shaker attached to the submersible pump for one or more operating cycles.

2. The computer-implemented method of claim 1, wherein the one or more sensors comprises the debris sensor, wherein the debris sensor is coupled to an impeller of the submersible pump, the debris sensor operating to measure a build-up of debris or particulates around the impeller of the submersible pump.

3. The computer-implemented method of claim 2, wherein analyzing the received data from the one or more sensors includes analyzing data received from the debris sensor to detect the failure in the submersible pump by determining if the build-up of debris or particulates as measured by the debris sensor exceeds a threshold.

4. The computer-implemented method of claim 1, wherein the one or more sensors comprises the acoustic sensor, wherein the acoustic sensor is coupled to a motor of the submersible pump, the acoustic sensor operating to measure sounds produced by the motor.

5. The computer-implemented method of claim 4, wherein analyzing the received data from the one or more sensors includes analyzing data received from the acoustic sensor to detect the failure in the submersible pump by determining if the sound produced by the motor indicates a stalling or jamming in the submersible pump as a result of a build-up of debris or particulates.

6. The computer-implemented method of claim 1, further comprising:

receiving, by one or more processors, further data from the one or more sensors associated with the submersible pump at the end of the one or more operating cycles;

analyzing, by one or more processors, the further data to determine if the failure detected in the submersible pump is still present at the end of the one or more operating cycles; and in response to determining that the failure detected in the submersible pump is still present at the end of the one or more operating cycles, providing, by one or more processors, an alert message to a user.

7. The computer-implemented method of claim 1, wherein the mechanical shaker is attached to the submersible pump directly.

8. The computer-implemented method of claim 1, wherein the mechanical shaker is attached to the submersible pump by an arm that extends from the mechanical shaker.

9. A non-transitory computer-readable storage medium including computer-readable instructions to be executed on one or more processors of a system for resolving failures in submersible pumps, the instructions when executed causing the one or more processors to:

receive data from one or more sensors associated with a submersible pump, the one or more sensors comprising at least one of a debris sensor or an acoustic sensor;

analyze the received data from the one or more sensors to detect a failure in the submersible pump; and in response to detecting the failure in the submersible pump, automatically activate a mechanical shaker attached to the submersible pump for one or more operating cycles.

10. The non-transitory computer-readable storage medium of claim 9, wherein the one or more sensors comprises the debris sensor, wherein the debris sensor is coupled to an impeller of the submersible pump, the debris sensor operating to measure a build-up of debris or particulates around the impeller of the submersible pump.

11. The non-transitory computer-readable storage medium of claim 10, wherein the instructions to analyze the received data from the one or more sensors include analyzing data received from the debris sensor to detect the failure in the submersible pump by determining if the build-up of debris or particulates as measured by the debris sensor exceeds a threshold.

12. The non-transitory computer-readable storage medium of claim 9, wherein the one or more sensors comprises the acoustic sensor, wherein the acoustic sensor is coupled to a motor of the submersible pump, the acoustic sensor operating to measure sounds produced by the motor.

13. The non-transitory computer-readable storage medium of claim 12, wherein the instructions to analyze the received data from the one or more sensors include analyzing data received from the acoustic sensor to detect the failure in the submersible pump by determining if the sound produced by the motor indicates a stalling or jamming in the submersible pump as a result of a build-up of debris or particulates.

14. The non-transitory computer-readable storage medium of claim 9, further including instructions that, when executed, cause the one or more processors to:

receive further data from the one or more sensors associated with the submersible pump at the end of the one or more operating cycles;

analyze the further data to determine if the failure detected in the submersible pump is still present at the end of the one or more operating cycles; and in response to determining that the failure detected in the submersible pump is still present at the end of the one or more operating cycles, provide an alert message to a user.

15. A system for resolving failures in submersible pumps, the system comprising:

a submersible pump;

a mechanical shaker coupled to the submersible pump; and a control unit, including a memory having instructions for execution on one or more processors, the instructions, when executed by the one or more processors, cause the control unit to:

receive data from one or more sensors coupled to the submersible pump;

analyze the received data from the one or more sensors to detect a failure in the submersible pump, wherein the one or more sensors comprise at least one of a debris sensor or an acoustic sensor; and in response to detecting the failure in the submersible pump, automatically activate the mechanical shaker for one or more operating cycles.

16. The system of claim 15, wherein the one or more sensors comprises the debris sensor, wherein the debris sensor is coupled to an impeller of the submersible pump, the debris sensor operating to measure a buildup of debris or particulates around the impeller of the submersible pump.

17. The system of claim 16, wherein the instructions of the control unit, when executed by the one or more processors to analyze the received data from the one or more sensors include instructions to analyze data received from the debris sensor to detect the failure in the submersible pump by determining if the build-up of debris or particulates as measured by the debris sensor exceeds a threshold.

18. The system of claim 15, wherein the one or more sensors comprises the acoustic sensor, wherein the acoustic sensor is coupled to a motor of the submersible pump, the acoustic sensor operating to measure sounds produced by the motor.

19. The system of claim 18, wherein the instructions of the control unit, when executed by the one or more processors to analyze the received data from the one or more sensors include instructions to analyze data received from the acoustic sensor to detect the failure in the submersible pump by determining if the sound produced by the motor indicates a stalling or jamming in the submersible pump as a result of a build-up of debris or particulates.

20. The system of claim 15, wherein the instructions of the control unit, when executed by the one or more processors, further cause the control unit to:

receive further data from the one or more sensors coupled to the submersible pump at the end of the one or more operating cycles;

analyze the further data to determine if the failure detected in the submersible pump is still present at the end of the one or more operating cycles; and in response to determining that the failure detected in the submersible pump is still present at the end of the one or more operating cycles, provide an alert message to a user.

21. The system of claim 15, wherein the mechanical shaker is integrated with the submersible pump.

* * * * *